US007884738B2

(12) United States Patent
Pappas et al.

(10) Patent No.: US 7,884,738 B2
(45) Date of Patent: Feb. 8, 2011

(54) EMERGENCY TRAFFIC LIGHT SYSTEM

(75) Inventors: Thomas Speros Pappas, Dearborn, MI (US); Richard William Carpenter, Schoolcraft, MI (US); Anthony C. Savalle, Grosse Pointe Shores, MI (US)

(73) Assignee: E-Light LLC, Livonia, MI (US)

( * ) Notice: Subject to any disclaimer, the term of this patent is extended or adjusted under 35 U.S.C. 154(b) by 461 days.

(21) Appl. No.: 11/874,880

(22) Filed: Oct. 18, 2007

(65) Prior Publication Data

US 2008/0094249 A1 Apr. 24, 2008

Related U.S. Application Data

(60) Provisional application No. 60/862,094, filed on Oct. 19, 2006.

(51) Int. Cl.
*G08G 1/087* (2006.01)

(52) U.S. Cl. ..... 340/906; 340/815.45; 340/902; 340/917

(58) Field of Classification Search ..... 340/906, 340/815.45, 902
See application file for complete search history.

(56) References Cited

U.S. PATENT DOCUMENTS 1,875,748 A 9/1932 Massey
3,119,093 A * 1/1964 Willyard ..... 340/913

(Continued)

FOREIGN PATENT DOCUMENTS

JP 02069900 A 3/1990

OTHER PUBLICATIONS

PCT/US07/081873 International Search Report dated Apr. 29, 2008.

*Primary Examiner*—Benjamin C Lee
*Assistant Examiner*—Anne V Lai
(74) *Attorney, Agent, or Firm*—Ray Meiers; Meiers Law Office LLC

(57) ABSTRACT

A visual warning assembly for disposal at an intersection of a plurality of roadways is disclosed herein. The visual warning assembly includes a housing with first and second openings facing first and second directions. The first and second directions are transverse to one another. The visual warning assembly also includes a first light assembly positioned in the first opening and having a plurality of light emitting diodes arranged in pattern representing an emergency vehicle. The visual warning assembly also includes a second light assembly positioned in the second opening and having a plurality of light emitting diodes arranged in pattern representing an emergency vehicle. The visual warning assembly also includes a signal receiver physically supported by the housings or one or both of the first and second light assemblies. The signal receiver or sensor is operable to receive and communicate a signal emitted by a signal emitter associated with an emergency vehicle. The visual warning assembly also includes a controller physically supported by the housing or one or both of the first and second light assemblies. The controller is in communication with the first and second light assemblies and the signal receiver. In response to receiving the signal from the signal receiver, the controller is operable to selectively direct power to the first and second light assemblies from a power source such that only one of the first and second light assemblies is illuminated at any particular time to limit power consumption and heat generation by the visual warning assembly.

6 Claims, 5 Drawing Sheets

U.S. PATENT DOCUMENTS 4,017,825 A * 4/1977 Pichey ..... 340/906
4,135,144 A * 1/1979 Elmasian ..... 340/906
4,271,408 A 6/1981 Teshima et al.
4,704,610 A 11/1987 Smith et al.
4,775,865 A 10/1988 Smith et al.
5,345,232 A * 9/1994 Robertson ..... 340/906
5,889,475 A * 3/1999 Klosinski et al. ..... 340/902
5,926,112 A 7/1999 Hartzell
5,955,968 A 9/1999 Bentrott et al.
5,977,883 A 11/1999 Leonard et al.
6,064,319 A * 5/2000 Matta ..... 340/917
6,072,406 A 6/2000 Leonard et al.
6,441,749 B1 8/2002 Edwards
6,448,904 B1 9/2002 Flores
6,693,556 B1 2/2004 Jones
6,762,689 B2 7/2004 Dechape
6,809,655 B1 * 10/2004 Colby ..... 340/907
6,847,306 B2 1/2005 Diba et al.
6,850,169 B2 2/2005 Manavi et al.
6,940,422 B1 9/2005 Bachelder et al.
6,967,593 B2 11/2005 Carroll
6,980,125 B1 * 12/2005 Barber ..... 340/917
6,987,464 B2 * 1/2006 Pearson ..... 340/902
7,006,011 B1 2/2006 Colby
7,167,106 B2 1/2007 Haase
7,317,406 B2 * 1/2008 Wolterman ..... 340/917
7,327,280 B2 * 2/2008 Bachelder et al. ..... 340/906
2003/0006909 A1 * 1/2003 Basson et al. ..... 340/906
2003/0098801 A1 5/2003 Martin
2004/0008127 A1 * 1/2004 Manavi et al. ..... 340/907
2004/0155795 A1 8/2004 Quintana
2005/0035878 A1 2/2005 Vassilevsky
2005/0046595 A1 * 3/2005 Blyth ..... 340/908
2005/0104745 A1 5/2005 Bachelder et al.
2005/0231381 A1 * 10/2005 Pederson et al. ..... 340/815.45
2005/0231385 A1 10/2005 Haase
2007/0115139 A1 * 5/2007 Witte et al. ..... 340/909

* cited by examiner

EMERGENCY TRAFFIC LIGHT SYSTEM

CROSS-REFERENCE TO RELATED APPLICATIONS

This application claims the benefit of U.S. Provisional Patent Application Ser. No. 60/862,094 for an EMERGENCY TRAFFIC LIGHT, filed on Oct. 19, 2006, which is hereby incorporated by reference in its entirety.

BACKGROUND OF THE INVENTION

1. Field of the Invention

The invention relates to a system for controlling traffic at an intersection and more specifically to a system for controlling traffic at an intersection including at least one distinct light for warning of an approaching emergency vehicle.

2. Description of Related Prior Art

Roadway traffic is becoming a growing concern because the number of the vehicles operating on the road has been increasing and because the top speed of vehicle has increased. The concern is relevant in urban areas because the quantity of vehicles on the road often exceeds the originally-intended capacity of the system of roadways. The concern is relevant to outlying areas because intersections may be provide limited visibility. One particular aspect of the general concern lies in emergency vehicles. Specifically, when responding to an emergency, an emergency vehicle must often cross streets at high speed. The cross-traffic may also be moving at high speed. Emergency vehicles may also be exceeding local speed limits and passing other vehicles to complicate the issue. Although these maneuvers may be necessary to properly respond to the emergency, it creates hazardous conditions for other motorists and pedestrians.

SUMMARY OF THE INVENTION

In summary, the invention is a visual warning assembly for disposal at an intersection of a plurality of roadways. The visual warning assembly includes a housing with first and second openings facing first and second directions. The first and second directions are transverse to one another. The visual warning assembly also includes a first light assembly positioned in the first opening and having a plurality of light emitting diodes arranged in pattern representing an emergency vehicle. The visual warning assembly also includes a second light assembly positioned in the second opening and having a plurality of light emitting diodes arranged in pattern representing an emergency vehicle. The visual warning assembly also includes a signal receiver physically supported by the housings or one or both of the first and second light assemblies. The signal receiver or sensor is operable to receive and communicate a signal emitted by a signal emitter associated with an emergency vehicle. The visual warning assembly also includes a controller physically supported by the housing or one or both of the first and second light assemblies. The controller is in communication with the first and second light assemblies and the signal receiver. In response to receiving the signal from the signal receiver, the controller is operable to selectively direct power to the first and second light assemblies from a power source such that only one of the first and second light assemblies is illuminated at any particular time to limit power consumption and heat generation by the visual warning assembly.

BRIEF DESCRIPTION OF THE DRAWINGS

Advantages of the present invention will be readily appreciated as the same becomes better understood by reference to the following detailed description when considered in connection with the accompanying drawings wherein.

DETAILED DESCRIPTION OF THE EXEMPLARY EMBODIMENT

Figure 1:
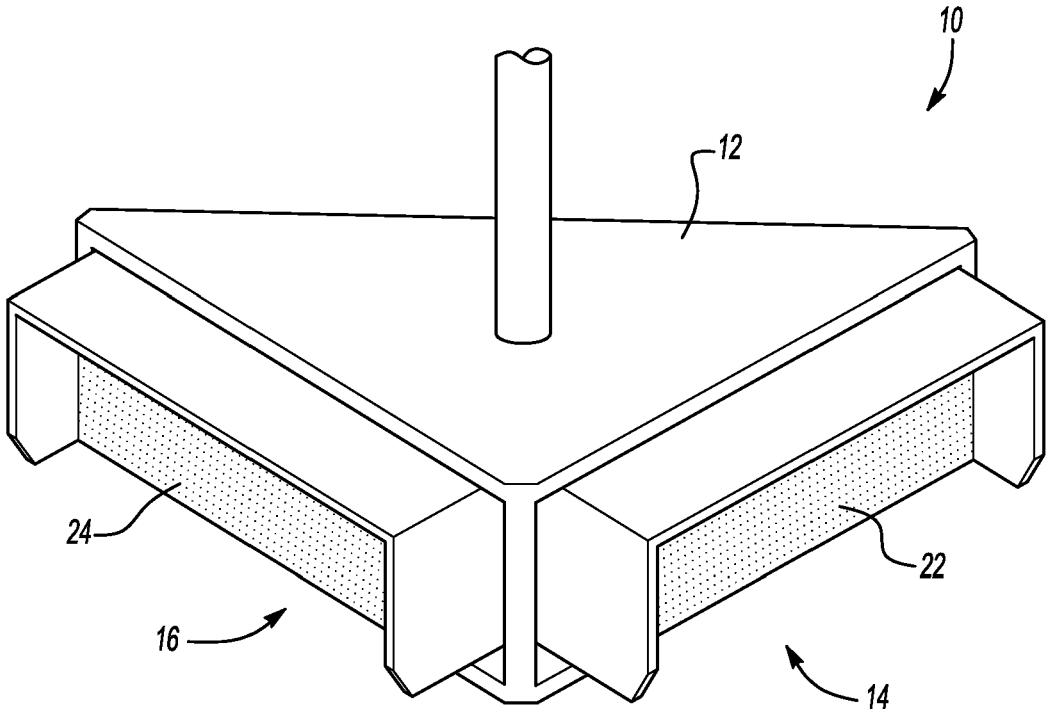
FIG. 1 is a perspective view of a visual warning assembly according to the exemplary embodiment of the invention.

A plurality of different embodiments of the invention are shown in the Figures of the application. Similar features are shown in the various embodiments of the invention. Similar features have been numbered with a common reference numeral and have been differentiated by an alphabetic suffix. Similar features are structured similarly, operate similarly, and/or have the same function unless otherwise indicated by the drawings or this specification. Furthermore, particular features of one embodiment can replace corresponding features in another embodiment unless otherwise indicated by the drawings or this specification.

Figure 2:
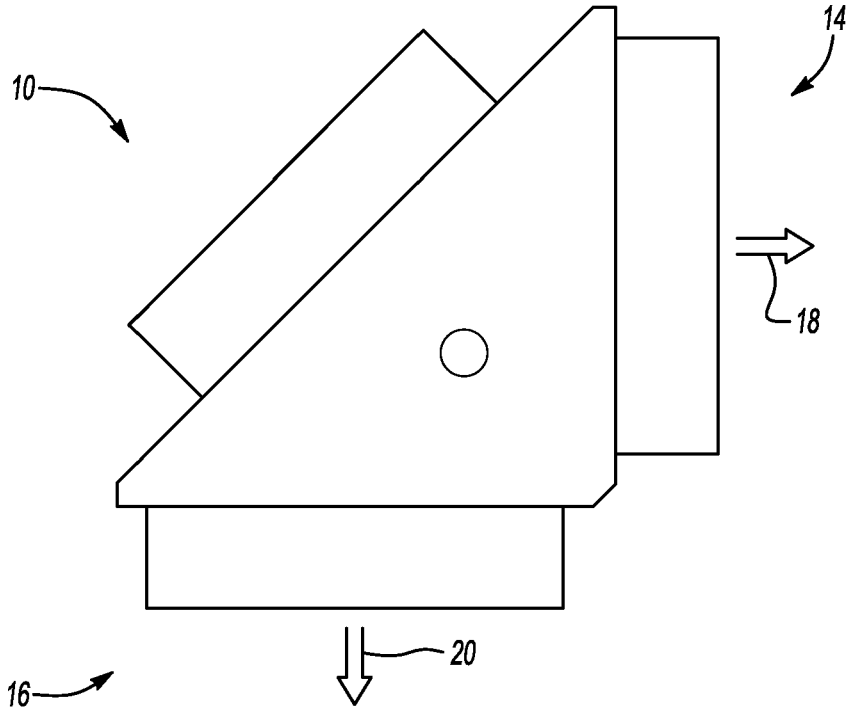
FIG. 2 is a top view of the exemplary visual warning assembly.
Figure 3:
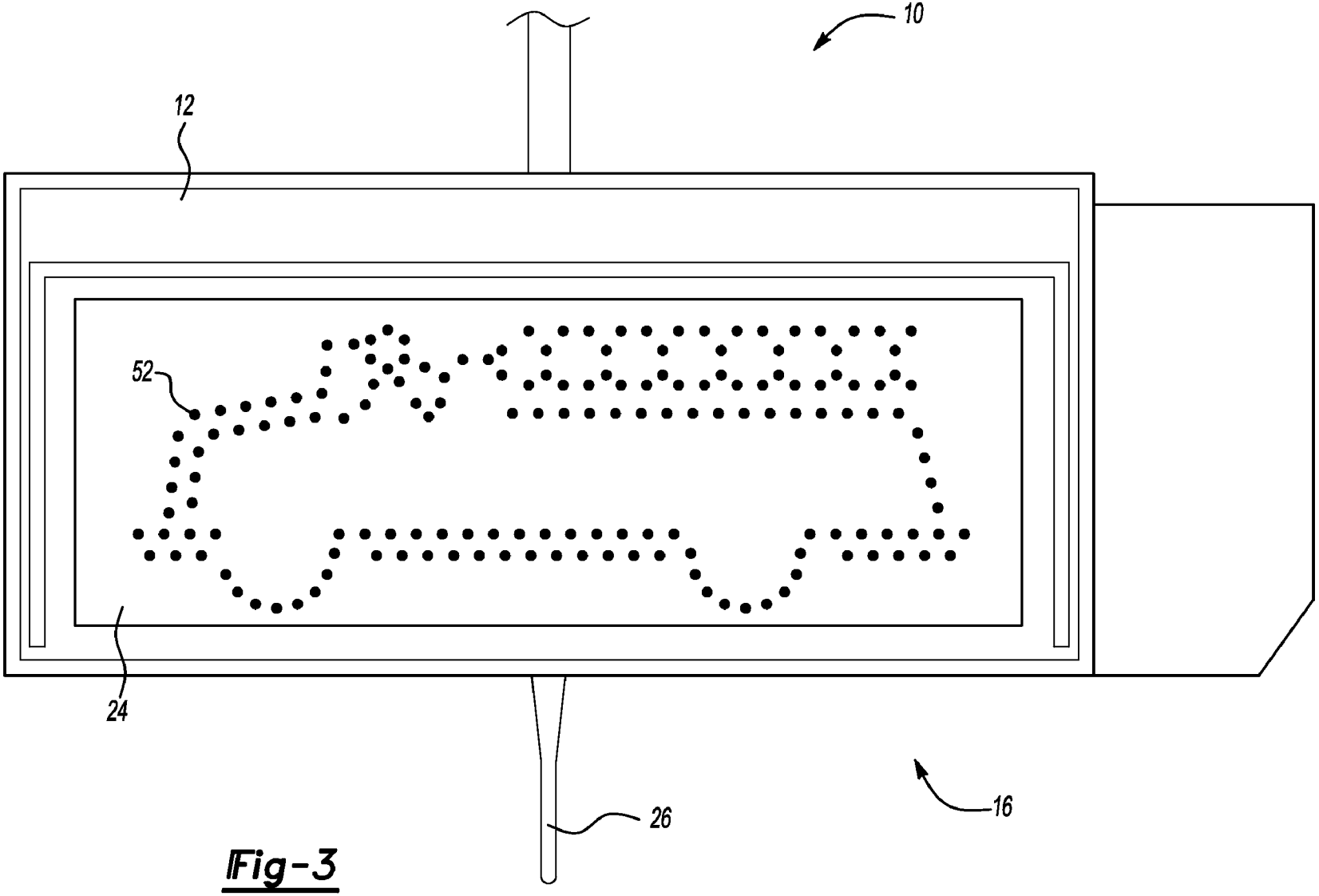
FIG. 3 is a front view of the exemplary visual warning assembly.

Referring now to FIGS. 1-3, an exemplary visual warning assembly 10 is for disposal at an intersection of a plurality of roadways. The visual warning assembly 10 includes a housing 12 with first and second openings 14, 16 facing in first and second directions 18, 20. The first and second directions 18, 20 are transverse to one another. In the exemplary embodiment of the invention, the first and second opening 18, 20 are perpendicular to one another; however, in alternative embodiments of the invention, the first and second directions 18, 20 may be more or less than perpendicular. The exemplary housing 12 is constructed using aluminum sheeting, such as T6 aircraft grade aluminum. Any seams in the housing 12 can be welded closed. Preferably, the housing 12 is weather resistant. The housing 12 can be coded with a yellow powder coat paint.

The visual warning assembly 10 also includes a first light assembly 22 positioned in the first opening 14. The first light assembly 22 includes a plurality of light emitting diodes (LEDs) 52 arranged in a pattern representing an emergency vehicle, such as a fire truck. The light emitting diodes can be covered by a sheet of lexan. The lexan has a blocking effect such that when the LEDs 52 are not emitting light the pattern of the emergency vehicle is not visible. The first light assembly 622 can be approximately 14 inches by 30 inches. The first light assembly 22 can be engaged with the housing 12 in a hinged relationship such that the first light assembly 22 can be serviced without being completely removed from the housing 12. It may be desirable to dispose a gasket between the housing and the light assembly to prevent moisture and fogging of the first light assembly 22. The visual warning assembly 10 also includes a second light assembly 24 positioned in the second opening 16. The second light assembly 24 is substantially the same as the first light assembly 22.

The visual warning assembly 10 also includes a signal receiver, represented by an antenna 26. The antenna is shown extending from the bottom of the assembly 10, but could extend from a side or a top of the assembly 10. The signal receiver is physically supported by either the housing 12 or one of the first and second light assemblies 22, 24. The signal receiver 26 is operable to receive and communicate a signal emitted by a signal emitter associated with an emergency vehicle. A comparator can be operably disposed ahead of the signal receiver to allow the signal receiver to sleep and thereby limit power consumption.

Figure 4:
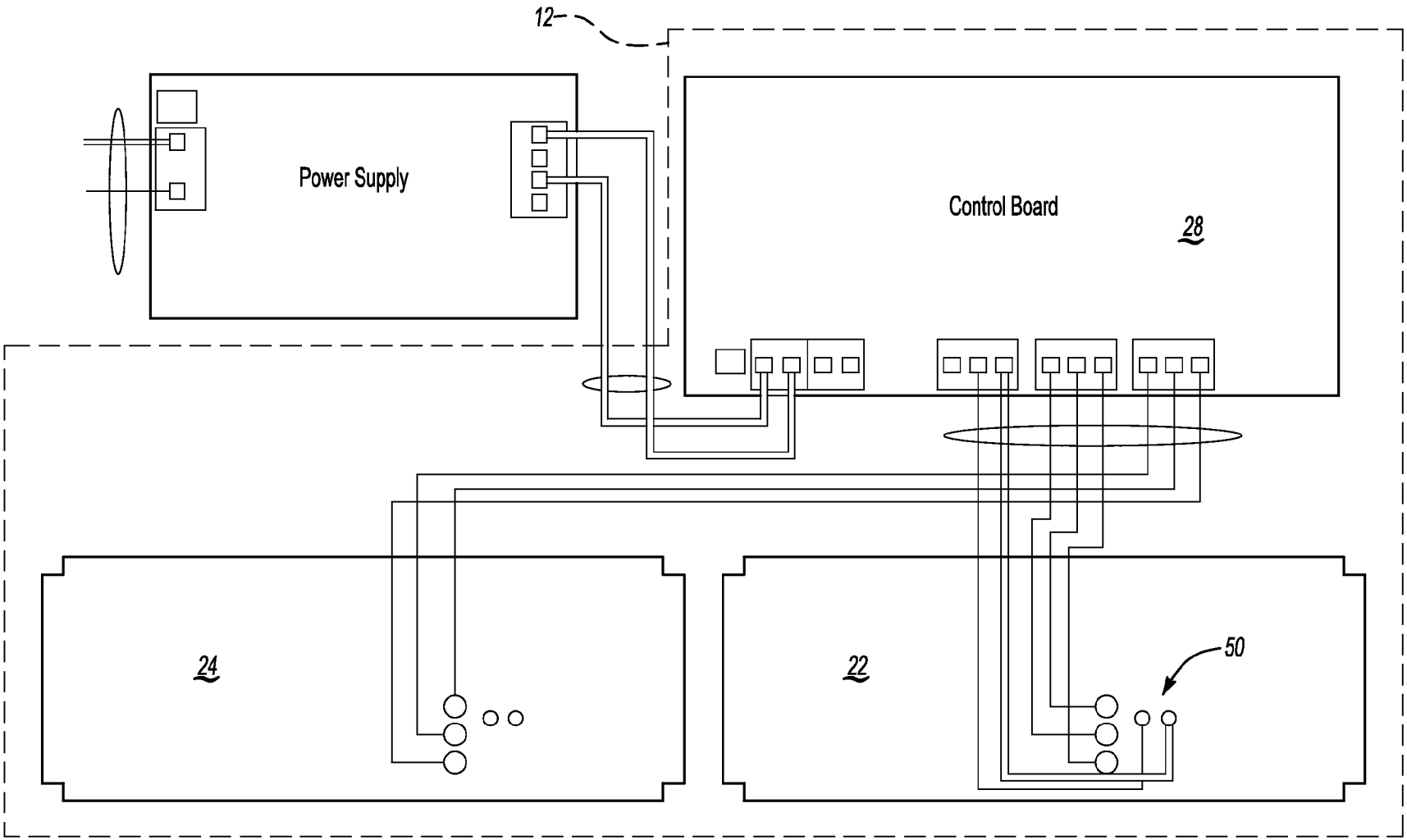
FIG. 4 is a schematic wiring diagram of the exemplary visual warning assembly.
Figure 5:
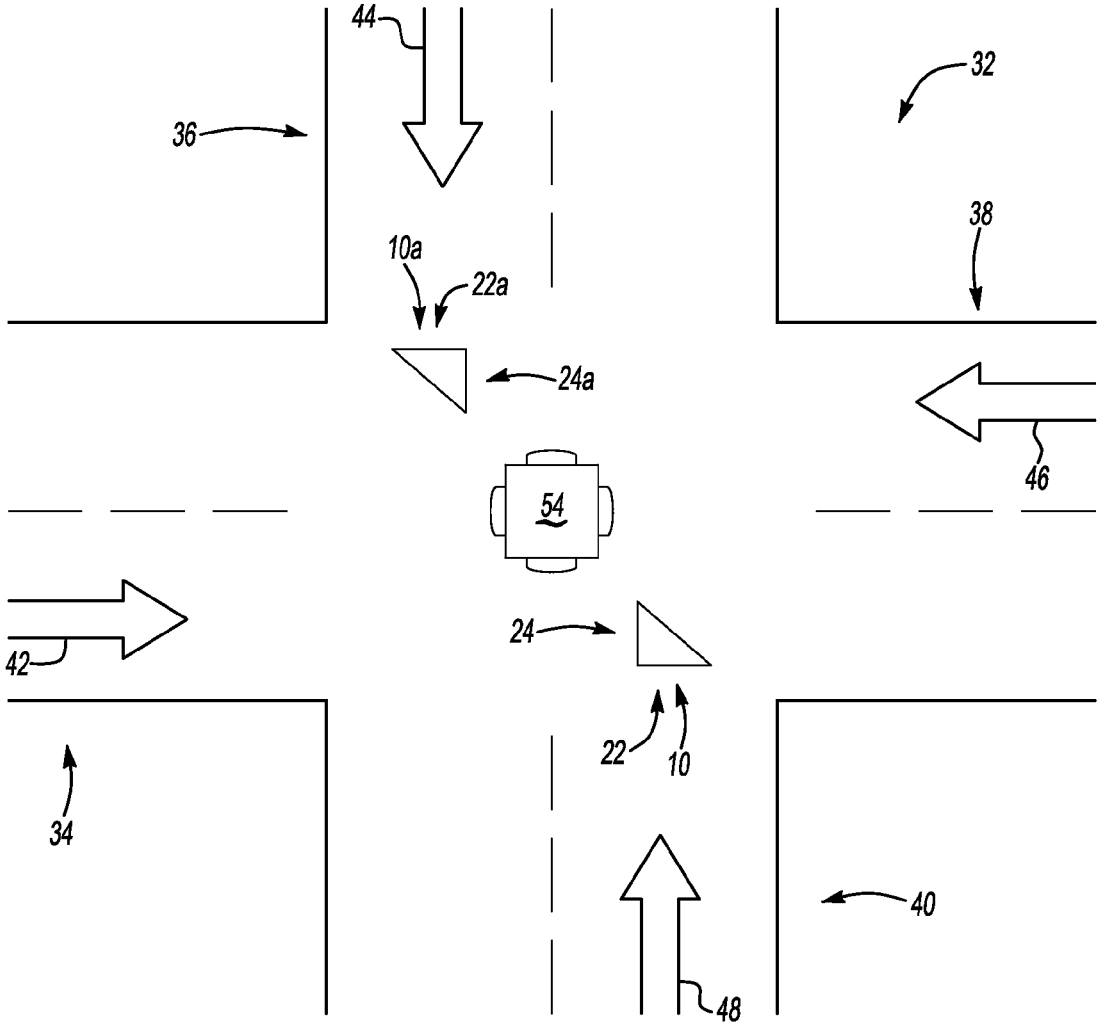
FIG. 5 is an overhead schematic view of an intersection according to the exemplary embodiment of the invention.

Referring now also to FIG. 4, The visual warning assembly 10 also includes a controller 28 physically supported by the housing 12 or one of the first and second light assemblies 22, 24. The controller 28 is in communication with first and second light assemblies 22, 24 and the signal receiver 26. The controller 28 can also be operated in sleep mode until the comparator receives an appropriate signal and wakes up the signal receiver 26 and the controller 28. In response to receiving an appropriate signal from the signal receiver 26 corresponding to the approach of an emergency vehicle, the controller 28 is operable to selectively direct power to one of the first and second light assemblies 22, 24 from a power source such that the LEDs 52 of only one of the first and second light assemblies 22, 24 is illuminated in any particular time. This operation limits power consumption and heat generation by the visual warning assembly 10.

The particular size of the supply can be determined at the time of implementation in a particular operating environment. Generally, it is expected that the power supply will be approximately 13.5 volts at 3 amps, but other power supply voltages and currents may be applied in alternative embodiments of the invention. A battery backup can be an option in alternative embodiments of the invention. Furthermore, the invention can be practiced wherein the visual warning assembly includes a solar powered battery recharging system.

Figure 6:
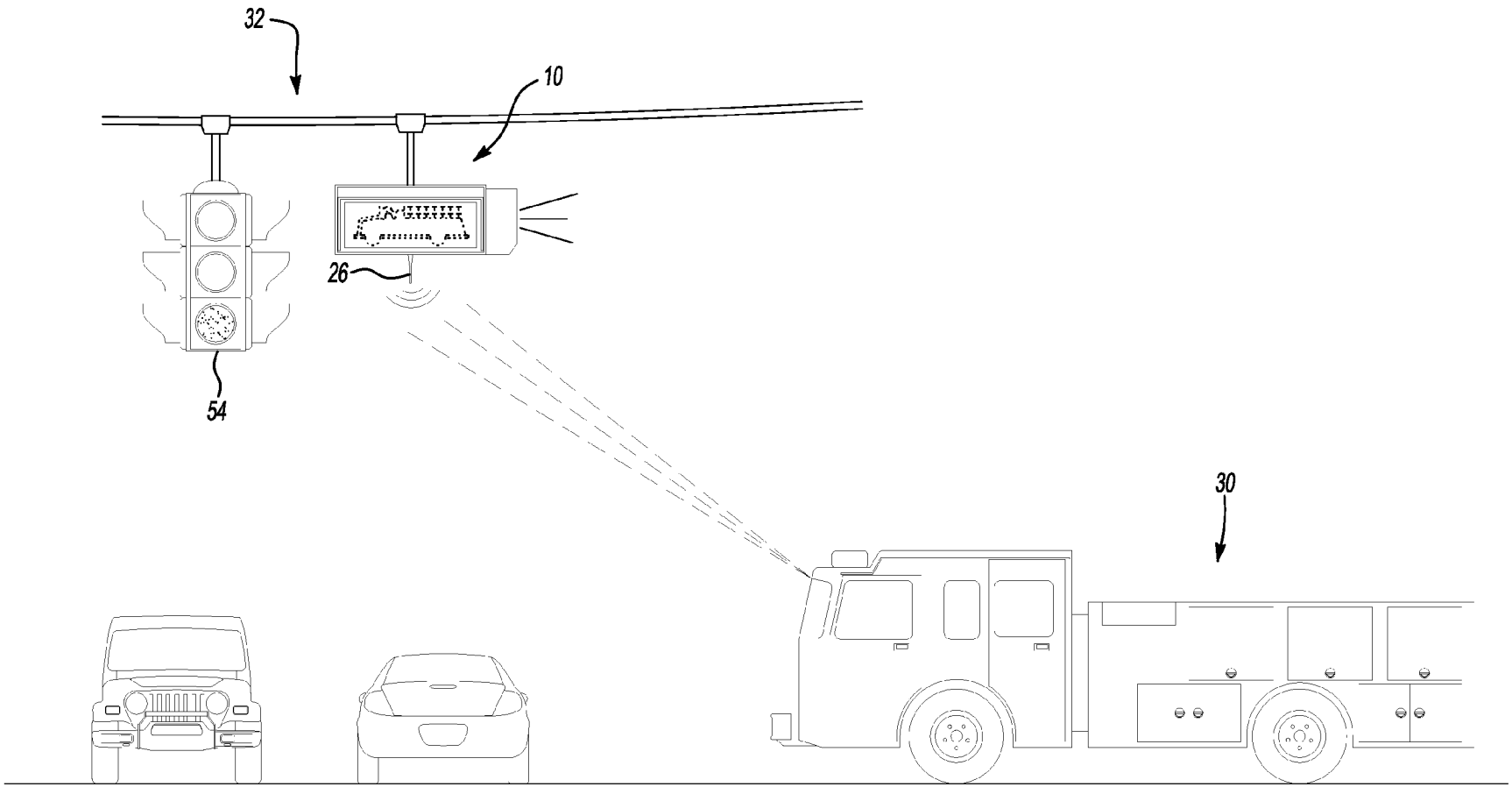
FIG. 6 is a street-level view of the exemplary intersection.

The operation of the exemplary embodiment of the invention will now be described with reference to all of the drawings. An emergency vehicle 30, such as shown in FIG. 6, can approach an intersection 32 with a standard traffic light 54 in response to a call for assistance. The intersection 32 is defined by roadways 34, 36, 38, 40. Traffic on the roadway 34 approaches the intersection 32 in a direction 42. Similarly, traffic approaches the intersection 32 along the roadway 36 in a direction 44. Similarly, traffic approaches the intersection 32 in a direction 46 along the roadway 38. Similarly, traffic approaches the intersection 32 in a direction 48 along the roadway 40. Light assembly 22 of an assembly 10 faces traffic moving in the direction 48, light assembly 24 faces traffic approaching in the direction 42, light assembly 24*a* of an assembly 10*a* faces traffic approaching in the direction 46, and light assembly 22*a* faces traffic approaching in the direction 44. The assemblies 10, 10*a* are disposed at opposite corners of the intersection 32.

The emergency vehicle 30 is fitted with a signal emitter for emitting a signal receivable by the signal receiver 26. The signal emitter associated with the emergency vehicle 30 can be wired into an emergency lighting system of the vehicle 30. The emergency lights on the vehicle 30 can be flashing lights, or rotating lights, or a combination of both kinds of lights. When the emergency lights of the vehicle 30 are engaged, the signal emitter will begin emitting a signal and will continue to emit a signal as long as the emergency lights of vehicle 30 are engaged. The signal emitter can be mounted anywhere in the vehicle. It may be preferable to form the signal emitter with a small profile to accommodate easy mounting. The signal emitter can be powered by 12 volts of direct current, taken from the vehicle power system.

The signal emitter can be a standard radio frequency transmitter. The range of the signal emitted by the signal emitter on the vehicle 30 can be relatively small such as several hundred feet in operating environments such as urban areas with small blocks. Alternatively, the range can be 2,500 feet, for example, in suburban areas. The range is affected by terrain and by man-made structures. In the exemplary embodiment of the invention, the frequency of the signal emitted by the signal emitter is in the Uhf radio frequency spectrum, however other frequencies can be used in alternative embodiments of the invention. The signal is encrypted to prevent hacking of the system, such as hacking in order to improperly activate the system. The signal can also include a serial number associated with the particular emergency vehicle 30 from which the signal was emitted.

The signal emitted by the signal emitter on the vehicle 30 can be received by a comparator associated with the signal receiver 26. The comparator can assess whether the signal is within an acceptable frequency range and, if so, communicate "wake-up" signals that activate the signal receiver 26 and the controller 28. The signal receiver 26 then receives the signal emitted by the signal emitter of the vehicle 30 and communicates the signal to the controller 28. The controller can be a microcontroller, such as of the Motorola/Freescale HC08 family. The signal receiver 26 and the controller 28 can share a common board, making service ability easier.

When the signal is received by the controller 28, the controller 28 controls the supply of power to the first and second light assemblies 22, 24. The controller 28 will control the flow of power such that the LEDs 52 of only one of the first and second light assemblies 22, 24 is lit at any one time. This control logic helps limit the power consumption and heat generation associated with the visual warning assembly 10. The light assemblies 22, 24 can be engaged such that each light is powered on for one-half of one second and powered off for one-half of one second. Alternatively, the light assemblies 22, 24 can be engaged and disengaged in different patterns in alternative embodiments of the invention.

The assembly 10 can also include a sensor 50 supported by the housing 12 or one of the first and second light assemblies 22, 24. The sensor 50 is an ambient light sensor operable to detect conditions associated with ambient light. The sensor 50 can communicate a signal to the controller 28 corresponding to then-current ambient light conditions. The controller 28 can interpret the signal from the sensor 50 and adjust the relative strength of the light assemblies 22, 24 when illuminated. In other words, the controller 28 can selectively dim the brightness of the LEDs of the light assemblies 22, 24 based on ambient light conditions. The detection of ambient light conditions can be performed using hysteretic methods to promote quick response to actual changes in ambient light conditions, while also minimizing the risk of errors in ambient light detection.

As the vehicle 30 approaches and passes the intersection 32, the signal receiver 26 and the controller 28 will continue to receive the signal emitted by the signal emitter on the vehicle 30. The controller 28 can monitor signal strength and selectively turn off the power to the first and second light assemblies 22, 24 in response to the vehicle 30 passing the intersection 32. The strength of the signal can be measured and sampled. For example, after three successive drops in signal strength the controller 28 can disengage the first and second light assemblies 22, 24 and return to sleep mode.

The exemplary embodiment of the invention can execute an early-off function. The signal strength can be monitored and measured throughout an light-activating event. The signal strength will initially be relatively low and increase to a maximum value when the emergency vehicle 30 is in the intersection 32. The signal will decrease in response to increasing distance between the assembly 10 and the vehicle 30. Thus, the signal strength can define a bell curve over time since the distance between the assembly 10 and the vehicle 30 increases and decreases over time. The controller 28 can be programmed to stop activation of the light assemblies 22, 24 when the signal strength has decreased from a maximum value to a value of about three-quarters of the maximum value. The practical effect of this function in operation is that intersection 32 can return to normal, non-emergency functioning relatively quickly after the passage of the vehicle 30 through the intersection.

The controller 28 can also be programmed with a communication protocol to address the possibility of multiple vehicles each bearing signal emitters moving relative to the intersection 32. For example, a situation may arise where one emergency vehicle has passed through the intersection and another is approaching the intersection 32. The controller 28 can be programmed to stay powered on, directing power to alternative light assemblies 22, 24, until all signals are sensed as decreasing in strength.

While the exemplary embodiment of the invention incorporates radio frequency communication, alternative embodiments of the invention could apply different techniques, such as infrared signaling.

The present invention provides a system for enhancing the safety, health and welfare of drivers and pedestrians. Emergency vehicles can move at high rates of speed and be undetected by drivers for several reasons. The present invention reduces the likelihood of collisions between emergency vehicles and other vehicles at an intersection. The present invention also provides a substantially improved emergency lighting system over the prior art. Prior art systems are excessively complicated. For example, the present invention provides a simple system of stand-alone visual warning assemblies that can function independently of a remote, centralized controller. Some prior art systems essentially require a complete re-design of all traffic control functions. The exemplary visual warning assemblies can function completely independently in any particular operating environment and can be incorporated seamlessly into existing intersections without modification of the existing traffic lights. In addition, the exemplary visual warning assemblies 10 consume a minimal amount of power since only one light assembly is flashed at any one time. This operating principle also minimizes the generation of heat. The arrangement in the proposed intersection is ideally arranged to provide maximum functionality without excessive complexity.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A visual warning assembly for disposal at an intersection of a plurality of roadways and comprising:

a housing with first and second openings facing first and second directions transverse to one another;

a first light assembly positioned in said first opening and having a plurality of light emitting diodes arranged in pattern representing an emergency vehicle;

a second light assembly positioned in said second opening and having a plurality of light emitting diodes arranged in pattern representing an emergency vehicle;

a signal receiver physically supported by one of said housing and said first and second light assemblies and operable to receive and communicate a signal emitted by a signal emitter associated with an emergency vehicle; and a controller physically supported by one of said housing and said first and second light assemblies and in communication with said first and second light assemblies and said signal receiver and, in response to receiving said signal from said signal receiver, operable to selectively direct power to said first and second light assemblies from a power source such that both can receive power from said power source but only one of said first and second light assemblies is illuminated at any particular time to limit power consumption and heat generation by said visual warning assembly and such that light is alternately flashed in said first and second directions.

2. The visual warning assembly of claim 1 wherein said controller is further defined as being reprogrammable from a source physically spaced from said housing.

3. The visual warning assembly of claim 1 wherein said controller is further defined as being operable to determine a strength of the signal emitted by the signal emitter and communicated by said signal receiver and also operable to cease power to said first and second light assemblies in response to a predetermined weakening of the signal emitted by the signal emitter.

4. The visual warning assembly of claim 1 further comprising:

a sensor operable to detect ambient lighting conditions and communicate a signal corresponding to ambient lighting conditions to said controller.

5. The visual warning assembly of claim 1 wherein said controller is further defined as being operable to cease power to said first and second light assemblies in response to a strength of the signal decreasing 25% from a maximum value.

6. A system for directing traffic at an intersection of a plurality of roadways and comprising:

at least one traffic light having a visual display for controlling movement of one or more vehicles at an intersection of a plurality of roadways;

a vehicle operable to approach the intersection and having at least one light operable to flash intermittently or rotate or both and also having a signal emitter, wherein said signal emitter and said at least one light are operably coupled such that both operate concurrently; and first and second visual warning assemblies each spaced from said at least one traffic light and spaced from one another at opposite corners of the intersection, each of said first and second visual warning assemblies comprising:

a housing with first and second openings facing first and second directions being transverse to one another;

a first light assembly positioned in said first opening and having a plurality of light emitting diodes arranged in pattern representing an emergency vehicle;

a second light assembly positioned in said second opening and having a plurality of light emitting diodes arranged in pattern representing an emergency vehicle;

a power source operable to communicate power to said first and second light assemblies;

a signal receiver physically supported by one of said housing and said first and second light assemblies and operable to receive and communicate said signal emitted by said signal emitter associated with said vehicle; and a controller physically supported by one of said housing and said first and second light assemblies and in communication with said first and second light assemblies and said signal receiver and, in response to receiving said signal from said signal receiver, operable to selectively direct power to said first and second light assemblies from a power source such that both can receive power from said power source but only one of said first and second light assemblies is illuminated at any particular time to limit power consumption and heat generation by said visual warning assembly and such that light is alternately flashed in said first and second directions.

* * * * *